US005926081A

United States Patent [19]

DiMarco et al.

[11] Patent Number: 5,926,081

[45] Date of Patent: Jul. 20, 1999

[54] CIRCUIT BREAKER HAVING A CAM STRUCTURE WHICH AIDS BLOW OPEN OPERATION

[75] Inventors: Bernard DiMarco; Bruce D. Guiney, both of Lilburn; Neal Reeves, Atlanta, all of Ga.

[73] Assignee: Siemens Energy & Automation, Inc., Alpharetta, Ga.

[21] Appl. No.: 08/936,003

[22] Filed: Sep. 23, 1997

[51] Int. Cl.[6] ..... H01H 75/00; H01H 3/00

[52] U.S. Cl. ..... 335/16; 335/190

[58] Field of Search ..... 200/17 R, 244, 200/254, 245, 288, 308, 312, 337, 401; 335/8–10, 16, 17, 147, 171, 172, 189, 190, 195, 201; 218/1, 22, 143, 153, 154

[56] References Cited

U.S. PATENT DOCUMENTS

| | | | |
|---|---|---|---|
| 4,259,651 | 3/1981 | Yamat | 335/16 |
| 4,480,242 | 10/1984 | Castonguay et al. | 335/194 |
| 4,488,133 | 12/1984 | McClellan et al. | 335/190 X |
| 4,554,427 | 11/1985 | Flick et al. | 200/245 X |
| 4,594,567 | 6/1986 | DiMarco et al. | 335/16 |
| 4,611,187 | 9/1986 | Banfi | 335/16 |
| 4,638,277 | 1/1987 | Thomas et. al. | 335/190 |
| 4,642,431 | 2/1987 | Tedesco et al. | 335/16 |
| 4,733,211 | 3/1988 | Castonguay et al. | 335/192 |
| 4,782,583 | 11/1988 | Castonguay et al. | 335/192 X |
| 4,906,967 | 3/1990 | Winter | 335/195 X |
| 4,931,603 | 6/1990 | Castonguay et al. | 218/1 |
| 5,004,878 | 4/1991 | Seymour et al. | 218/155 |
| 5,184,099 | 2/1993 | DiMarco et al. | 335/16 |
| 5,270,564 | 12/1993 | Parks et al. | 200/401 |
| 5,343,174 | 8/1994 | Turner et al. | 335/172 |
| 5,502,428 | 3/1996 | McColloch et al. | 335/172 |

*Primary Examiner*—J. R. Scott

[57] ABSTRACT

A circuit breaker includes a cam assembly which holds the load blade in contact with the line strap during normal operation. The cam assembly includes a cam surface on a cam which can slide along the load blade and a bearing surface on the load blade. In normal operation, the cam is biased on the load blade so that the cam surface engages the bearing surface. The force applied by the cam surface to the bearing surface in normal operation is approximately parallel to the force applied by the load blade to the line strap, thus, the cam surface does not tend to slide along the bearing surface during normal operation. When a high overcurrent fault occurs, blow-open forces exerted between the load blade and the line strap cause the cam to pivot to a position where the cam surface no longer engages the bearing surface, allowing the load blade to swing free of the cam and break the contact between the load blade and the line strap. As the load blade swings free of the cam, it engages a further cam surface of the cam which reduces the biasing force essentially to zero, thereby increasing the opening speed of the blade. In addition, the frictional force of the further cam surface against the load blade prevents the load blade from reestablishing contact with the line strap until the mechanism trips, keeping the load blade in the open position.

15 Claims, 6 Drawing Sheets

CIRCUIT BREAKER HAVING A CAM STRUCTURE WHICH AIDS BLOW OPEN OPERATION

BACKGROUND OF THE INVENTION

This invention relates to the contact operating mechanism of a circuit breaker and more particularly to a cam structure in that mechanism which improves blow-open performance of the contact arm of the circuit breaker during short circuit conditions.

The terms "blow open" or "blow off" are commonly used to describe a current interrupting mechanism which is used to handle very large short-circuit overcurrent conditions (e.g. when the current flow may be greater than 100 times the rated current of the breaker). The blow open mechanism causes the breaker contacts to open during the first millisecond that the overcurrent condition exists. This rapid operation is important to limit the current flow to a fraction of the available current and, therefore, to limit damage to the breaker and to apparatus connected to receive power through the circuit breaker.

The blow open force is a magnetic force which is generated by the large current flowing through a load contact arm (load blade) and a line contact arm (line strap) of the circuit breaker. To generate sufficient force to "blow open" the load and line contacts, the breaker is designed such that the load blade is in close proximity to and parallel to the line strap at least along part of its length. In addition, the currents flowing through the parallel portions of the load blade and the line strap are in opposite directions. This current flow produces opposing magnetic fields. Because the load blade and line strap are in close proximity, these opposing magnetic fields interact strongly, producing forces sufficient to blow the contacts apart more quickly than the current flow could be stopped by the instantaneous tripping function of the circuit breaker mechanism. When the contacts have been blown open, some current will continue to flow due to electrical arcs in the arc chamber and ionization of the air in the arc chamber. These currents plus the initial overcurrent condition, activate the trip mechanism of the breaker to ensure that the contacts do not reclose after they have been blown open.

The strength of the magnetic fields is a function of: 1) the amount of current flowing through the breaker, 2) the length of the parallel portions of the load blade and line strap and 3) the separation between the load blade and line contact. While this force can be made quite large by lengthening the parallel portions of the load blade and line strap, it may be difficult to implement a design of this type in the small space that is typically allowed for a circuit breaker. The blow-open force may also be increased by reducing the separation between the load blade and the line strap. This minimum separation, however, is limited by factors such as the need for strong electrical insulation between the load blade and line strap, the strength of the housing for the breaker and the ease with which the breaker may be assembled.

Another way in which the blow open force may be adjusted is to reduce the frictional force that holds the contacts closed during normal operation. If this force is reduced to too great an extent, however, the contacts may open during normal operation.

SUMMARY OF THE INVENTION

The present invention is embodied in a circuit breaker having a load contact arm and a line contact arm which are electrically connected to allow current to flow through the breaker. The load contact arm has a side face having a cam surface that engages a cam. The cam is mechanically coupled to the operating mechanism of the breaker and biased to apply a frictional force to the cam surface on the load contact arm so as to hold the load contact in a closed position during normal operation of the breaker. During a large overcurrent condition, a blow off force applied to the load contact arm produces a force which opposes the biasing force holding the cam in position. This produced force causes the cam to slide away from the cam surface allowing the load contact arm to swing free of the cam and break the connection with the line contact arm.

According to one aspect of the invention, the cam includes two pivot positions, one of which is used to direct the load blade during normal operation and another of which is used to produce the force which opposes the cam biasing force during a blow off condition.

According to another aspect of the invention, the cam is mechanically coupled to the contact surface on the blade such that, during normal operation, the force applied to the blade is substantially perpendicular to the contact area between the cam and the contact surface. Consequently, the cam does not slide relative to the contact surface during normal operation.

DETAILED DESCRIPTION OF THE INVENTION

Figure 1:
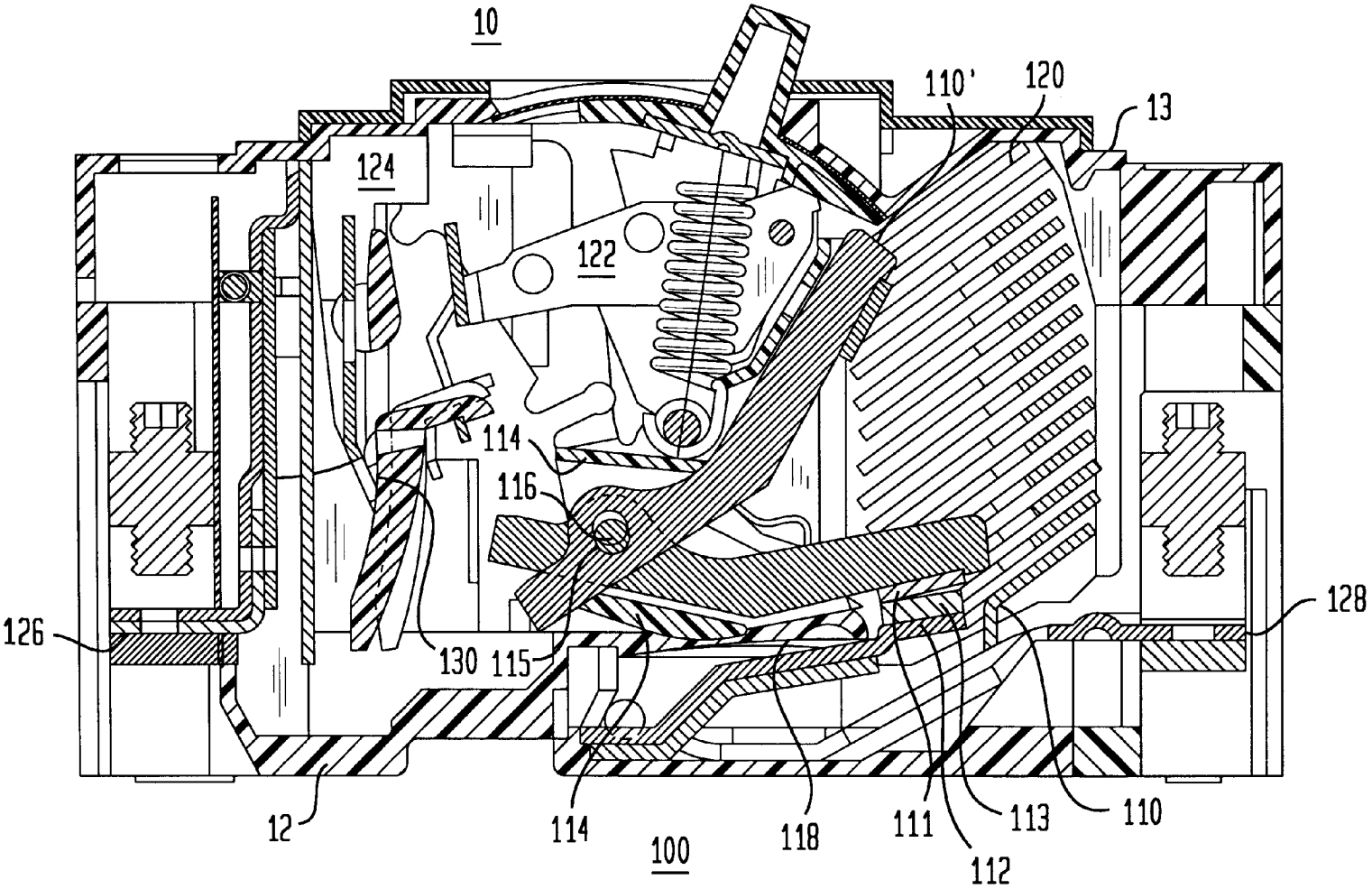
FIG. 1 is a sectional view of a circuit breaker taken along line 1—1 of FIG. 2, showing the contact arm assembly for the central phase of the breaker in the closed and blown-open positions.
Figure 2:
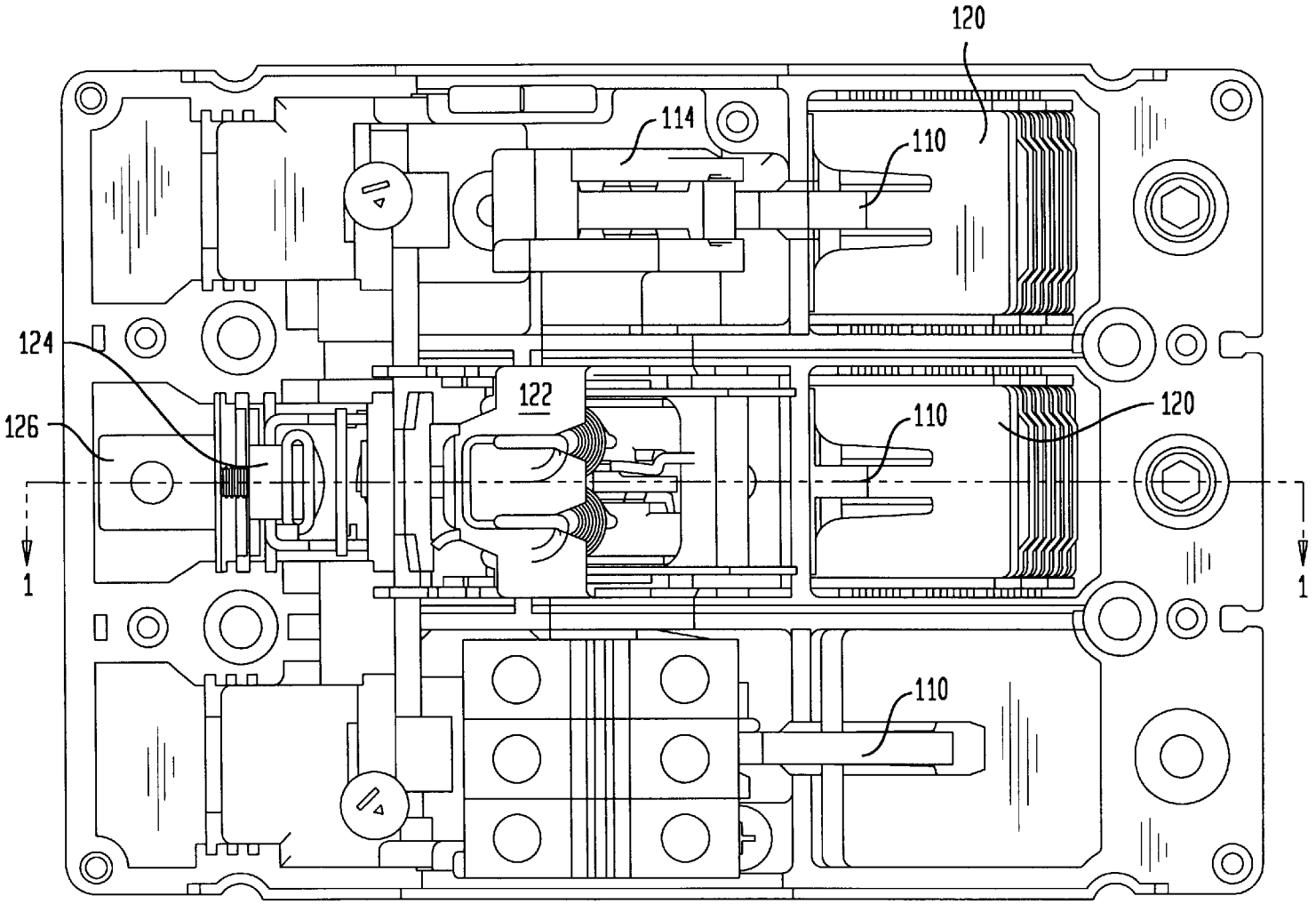
FIG. 2 is a top view of the circuit breaker with the cover removed to show components of the circuit breaker.

Referring to FIGS. 1 and 2, an exemplary circuit breaker 10 according to the present invention includes an insulating support base 12, and cover 13. The main components of the breaker are a pivoting and movable upper contact arm or load blade 110, a stationary lower contact arm or line strap 112, arc chambers 120, an upper contact arm operating mechanism 122, a thermal and magnetic trip unit 124, a load terminal 126 and a line terminal 128. The circuit breaker 10 is a multi-phase device having one load blade 110, one line strap 112, one load terminal 126 and one line terminal 128 for each phase.

The line strap 112, arc chambers 120, circuit breaker operating mechanism 122, trip unit 124, load terminal 126 and line terminal 128 are all of conventional design. Load blade 110 has a conventional electrical contact 111 brazed or otherwise fastened to a first end and a pivot hole 114 at its second end. The load blade 110 is connected to the thermal and magnetic trip unit 124 via a flexible connector (not shown). The trip unit 124, in turn, is connected to the load terminal 126. Electrical contact 111 engages and disengages electrical contact 113 which is brazed or otherwise fastened to a first end of line strap 112. Line strap 112 has a "V" shape and the other end of the "V" is connected to the line terminal 128. The base 12 of the breaker 10 includes an insulating barrier 118 which separates the load blade 110 from a roughly parallel portion of the line strap 112.

Each load blade 110 is pivotally attached to a crossbar 114 by a pivot pin 116 which extends through the pivot hole 115 of the load blade 110. In normal operation, the load blades 110 are fixed in the crossbar 114 by a cam 212 (not shown in FIGS. 1 and 2) and pivot only within a narrow range about the pivot pin 116 (as described below with reference to FIG. 7). The crossbar pivots on pivot bearings 216 between open and closed positions. During a blow-open condition, however, the crossbar does not pivot immediately. Instead, the load blade 110 is freed from the cam to pivot about pivot pin 116 in order to break contact with the line strap 112. After the load and line contacts have been blown open, the blow-open current and residual current flow causes the instantaneous trip mechanism of the breaker to rotate the crossbar in a counterclockwise position on the bearing 216 ensuring that the contacts do not reclose. The operation of the load blade 110, cam 212, and crossbar 114 are described below with reference to FIGS. 3A through 8.

In normal operation, the operating mechanism 122 rotates the crossbar 114 between open and closed positions. When the operating mechanism is in the closed position, it engages a spring-loaded latch which may be released by a trip bar 130. Because the load blades are fixed to the crossbar by the cams, the operating mechanism presses the load contacts 111 against the line contacts 113 when the breaker is in the closed position and separates the contacts 111 and 113 when the breaker is in the open position. When the crossbar is in its closed position and the trip unit 124 detects an overcurrent condition, it exerts pressure against the trip bar, releasing the latch and causing the breaker to open. While this trip mechanism is acceptable for relatively low-level faults, in relatively high-level fault conditions (e.g. greater than 100 times the breaker rating), it may not react with sufficient speed to prevent damage to the breaker 10 and to equipment or distribution lines attached to the load terminals 126. The blow-open mechanism of the present invention handles these high-level fault conditions.

As shown in FIG. 1, the load blade 110 and line strap 112 are parallel along a portion of their length separated from each other by an insulator 118. In normal operation, the load blade is fixedly attached to the cross bar assembly 114 by frictional forces which prevent the blade from becoming disengaged from the crossbar assembly during normal operation.

Figure 3A:
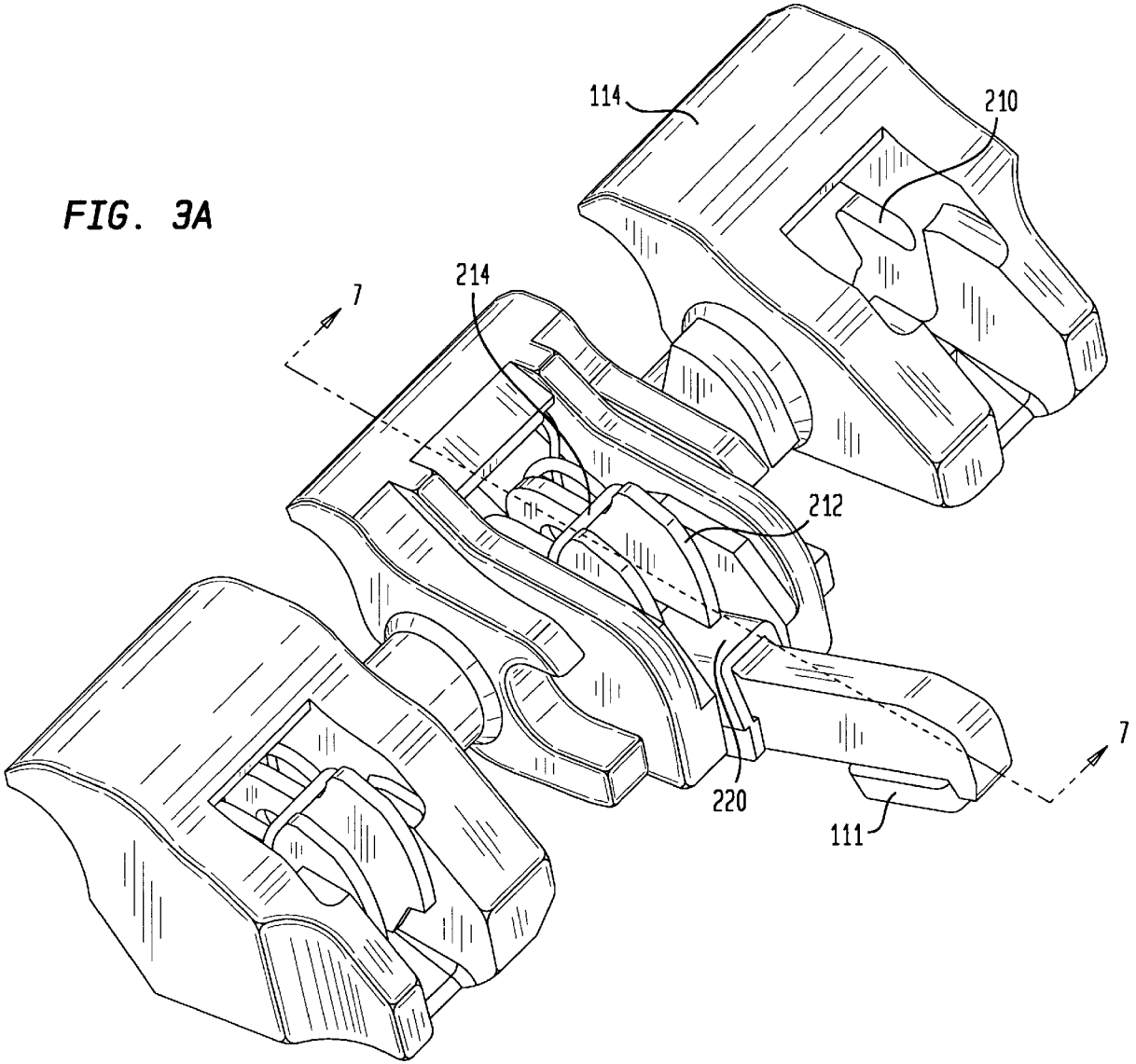
FIG. 3A, is an isometric drawing of a circuit breaker cross bar including one load blade assembly which is useful for describing the present invention.

During large over current conditions, for example when the current flowing through the load blade 110 and line strap 112 may be greater than 100 times the rated current of the breaker, a relatively large repulsive magnetic force is generated along the parallel lengths of the load blade 110 and line contact 112. This force is sufficient to disengage the load blade from the crossbar mechanism allowing it to break its contact with the line connector 112. FIG. 3A is an isometric drawing of a crossbar assembly for a three pole breaker showing details of the contact structure for the center pole. While the invention is described with reference to a 3 pole breaker, it is contemplated that it may be practice in a single pole breaker or in other multi-pole breakers.

The structure shown in FIG. 3A includes the load blade 110 and cross bar 114 in addition it includes cams 212, a spring 214 and a load blade clip 220. The combination of the cams 212, spring 214 and clip 220 hold the load blade 110 in a fixed position in the crossbar 114 during normal operation while allowing the blade 110 to quickly rotate in a counterclockwise position relative to the crossbar assembly 114 during a blow off condition.

As shown in FIG. 3A, each pole of the crossbar assembly 114 includes a notch 210 into which the pivot pin (not shown in FIG. 2) is inserted. The pivot pin 116 extends through the pivot hole 115 in the load blade 110 and a pivot hole (not shown in FIG. 3A) in cams 212. The load blade does not pivot about the pivot pin 116 during normal operation except for pivoting between a rest position (shown in phantom in FIG. 7) to a contact position (shown by solid lines in FIG. 7) to ensure that good contact is made between the load contact 111 and the line contact 113 (shown in FIG. 1). In addition, the pivot pin allows the load blade to move counter clockwise, away from the line strap 112 during a blow off condition.

The spring 214 is held in tension to the crossbar 114 on one end and to the cams 212 on the other end. Spring 214 has two functions. First, it holds the blade assembly mechanism including the pivot pin 116, load blade 110, load blade clip 220, and cam 212 into the crossbar 114. Second, as described below with reference to FIG. 7, the spring 214 biases the cams 212 in a position which engages a contact surface on the clip 220. During normal operation, the spring 214 holds the load contact 110 against the line contact 112 (shown in FIG. 1). During a blow off position, the spring 214 provides the initial force which must be overcome to free the load blade 110 from the cams 212, allowing the blade 110 to rotate in a counterclockwise direction away from the line strap 112.

Figure 3B:
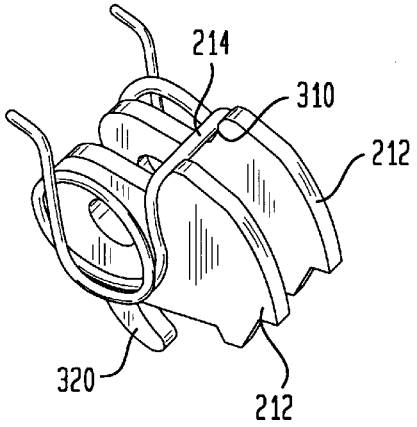
FIGS. 3B and 3C are isometric drawings which illustrate the mechanical coupling of the components of the circuit breaker cross bar assembly shown in FIG. 2.
Figure 3C:
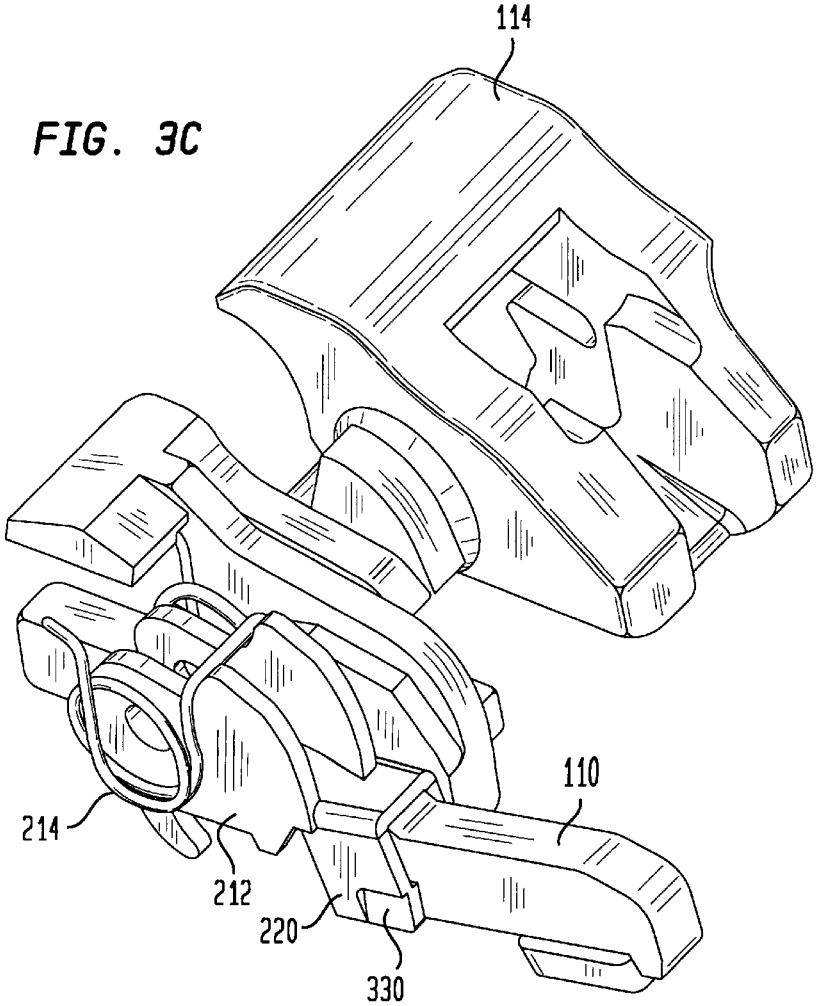

FIGS. 3B and 3C are isometric drawings which illustrate further details of the exemplary embodiment of the invention, including the cams 212, springs 214, load blade clip 220 and load blade 110. As shown in FIG. 3B, each load blade 110 includes two cams 212, one on either side. Each of the cams includes a surface 310 which engages the spring 214 and a cam pivot hole 630 which is described in more detail below with reference to FIGS. 7 and 8.

As shown in FIG. 3C, the load blade clip 220 is generally "U" shaped, each leg of the clip 220 having an "S" shaped features 330. These features 330 engage an indentation (not shown) in the blade 110 to hold the clip 220 securely to the blade 110.

Figure 4:
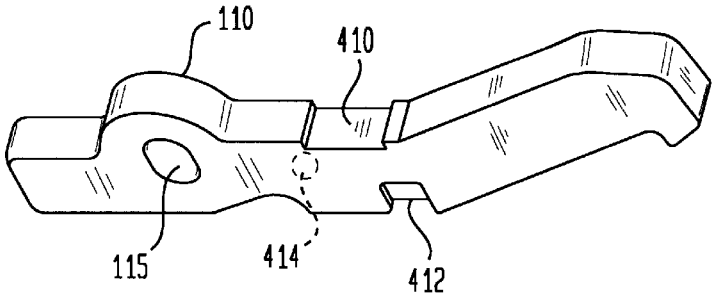
FIG. 4 is an isometric drawing of a load blade assembly suitable for use with the present invention.

FIG. 4 is an isometric drawing of the blade 110. As shown in FIG. 4, the load blade includes an oval pivot hole 115 through which a round pivot pin 116 (not shown) is inserted to attach the load blade to the cross bar assembly. The load blade 110 also includes an indentation 410 along its upper surface which receives the load blade clip 220. The "S" shaped features 330 on the legs of the load blade clip 220 engage the indentations 412 on the load blade to attach the load blade clip to the load blade. As described below with reference to FIGS. 5 through 8, the load blade clip 220 provides a surface which interacts with the cam 212 to cause the load blade 110 to move with the crossbar assembly 114 during normal operation and yet allow the blade 110 to rotate free of the crossbar and cam during a blow-off condition. As an alternative to the load blade clip 220, it is contemplated that a pin 414 (shown in phantom) may be inserted directly into the blade 110. The pin 414 engages the cam 212 in the same way as the bearing surface 514 of the clip 220 (shown in FIG. 5).

Figure 5:
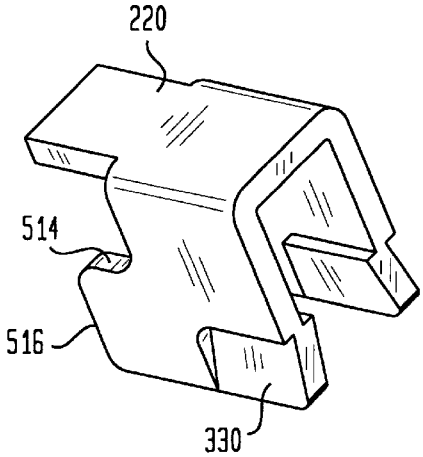
FIG. 5 is an isometric drawing of a blade clip assembly which is suitable for use with the load blade assembly shown in FIG. 4.

FIG. 5 is an isometric drawing of the load blade clip 220. The blade clip 220 is generally "U" shaped, having first and second legs and an upper connecting member. The connecting member engages the indentation 410 in the load blade 110 and the "S" shaped features 330 on the legs of the clip engage the indentations 412 on the load blade 110. These two features of the clip 220 allow it to be firmly attached to the load blade 110 as shown in FIG. 3C. Other key features of the load blade clip 220 are the bearing surface 514 which engages the cam 212 during normal operation and the front surface 516 which may slide along the cam 212 during blow-open operation, as described below with reference to FIGS. 7 and 8.

Figure 6:
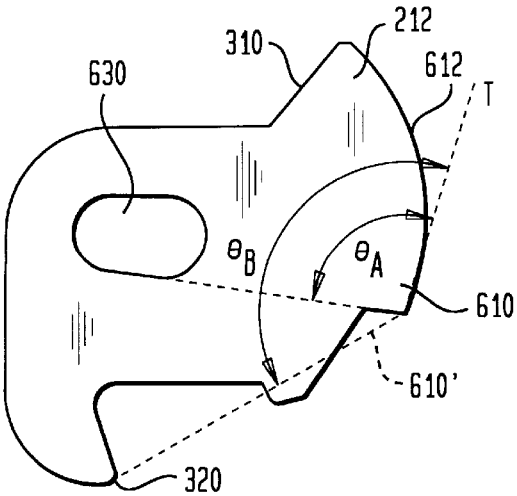
FIG. 6 is a side plan view of a cam that is suitable for use with the circuit breaker mechanism shown in FIGS. 2 through 5.

FIG. 6 is a side plan view of the cam 212. As shown in FIG. 6, the cam 212 includes an oval pivot hole 630 through which the round pivot pin 116 passes to attach the cam 212 to the load blade 110 and the crossbar 114. The cam also includes a surface 310 which engages one end of the spring 214 and a surface 610 which engages the bearing surface 514 of the load blade clip 220 during normal operation. As described below with reference to FIGS. 7 and 8, the cam 212 also includes a surface 612 along which the front surface of 516 of the load blade clip may slide in a blow-open operation and a spur 320 which forms a pivot point for the cam 212 to disengage the surface 610 from the bearing surface 514 during a blow open operation.

The cam surface 610 shown in FIG. 6 has an angle $\theta_A$ with respect to a tangent line T extending from the surface 612. The angle $\theta_A$ is determined as the angle between the tangent line T, and a line that is formed by extending the point at which the tangent line T intersects the surface 612 to the bottom of the pivot hole 630.

As described below, the frictional force exerted by the cam 212 on the blade clip 220 and thus the blade 110, may be varied by changing the angle $\theta_A$. The inventors have determined that acceptable operation, although at a reduced frictional force, may be obtained by changing the cam surface 610 to a cam surface 610' (shown in phantom). The surface 610' has an angle $\theta_B$ with respect to the tangent line T. The angle $\theta_B$ is the angle between the tangent line T and a line that is generated by extending a line between the point of intersection of the tangent line T and surface 612 and the lowest point on the cam 212, the bottom of the spur 320. Of course, angles between $\theta_A$ and $\theta_B$ may also be used to define a cam surface. This element of the cam 212 may be adjusted to adjust the biasing force exerted on the blade clip 220 by the cam 212. As described below, it is this biasing force which must be overcome to free the blade 110 and clip 220 from the cam 212 during blow-open operation. Thus, by adjusting the angle of the cam surface between $\theta_A$ and $\theta_B$, the force required to blow off the blade contact may be adjusted. Care must be taken however that sufficient biasing force remains to hold the blade contact in closed position during normal operation.

Figure 7:
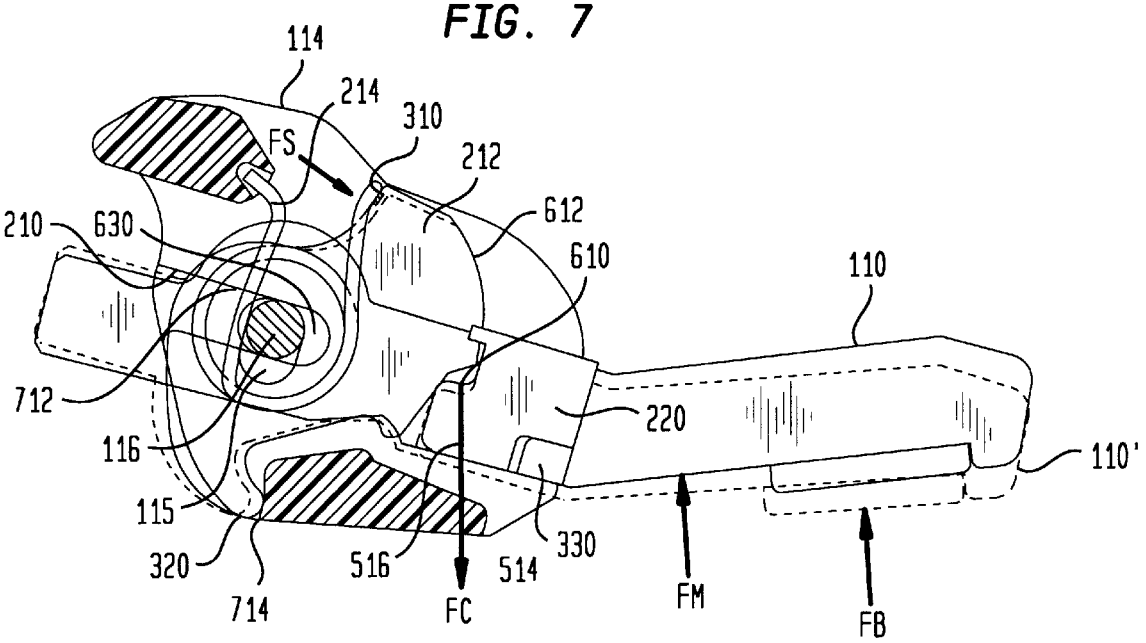
FIG. 7 is a cutaway view taken along the line 7—7 of FIG. 3A which illustrates the operation of the cam and load blade under normal operating conditions.

FIG. 7 is a cutaway view of the center pole of the crossbar assembly 114. The solid line drawing in FIG. 7 shows the position of the blade 110 relative to the crossbar 114 during ON position (i.e. when the load blade contact 111 engages the line contact 113, as shown in FIG. 1). The broken-line drawing shows the position of the load blade 110 when the breaker is in the "touch" or OFF position. In the OFF position, the crossbar assembly 114 is rotated counter clockwise about the pivot pin 216 from the position shown in FIG. 1. This orientation of the crossbar assembly 114 is not shown in FIG. 7. Instead in FIG. 7, the load blade is shown in two positions (110 and 110') relative to the crossbar assembly 114.

When connection is made between the load blade contact 111 and the line strap contact 113, a force $F_B$ is exerted against the contact 110'. In the exemplary embodiment of the invention, a counteracting force $F_C$ is exerted by the cam 212 against the load blade clip 220. In the exemplary embodiment of the invention, the force vector $F_C$ is approximately parallel to the force vector $F_B$. In this configuration, the cam 212 does not slide significantly against the load blade clip 220 when the breaker is switched from the "touch" or OFF position to the ON position. Because there is essentially no sliding between the cam surface 610 of the cam 212 and the bearing surface 514 of the load blade clip 220 during normal operation these surfaces exhibit only relatively small amounts of wear through repeated operation of the circuit breaker. Because these surfaces are not subject to regular wear during normal operation, the operation of the breaker will be consistent over its life and the integrity of the blow off mechanism is maintained over the life of the breaker.

As shown in FIG. 7, the pivot pin 116 extends through the slot 210 of the cross bar 114, through the oval pivot hole 115 in the blade 110 and through the oval pivot hole 630 in the cam 212. Spring 214 includes a straight leg 712 which retains the pivot pin in the crossbar assembly 114. As described above with reference to FIG. 3, the spring 214 has two legs, one engages the crossbar 114 and the other engages the surface 310 of the cam 212. In this configuration, the spring exerts a force $F_S$ against the cam 212 which in turn presses against the bearing surface 514 of the load blade clip 220. Because the load blade clip 220 is fastened securely to the load blade 110 this force is transferred to the load blade contact 113.

In addition to securing the cams 212 and load blade 110 to the cross bar 114, the spring 214 biases the cam 212 to the right as shown in FIG. 7, causing the cam surface 610 to engage the bearing surface 514 of the load blade clip 220. By biasing the cams to the right, the spring 214 ensures that maximum contact area exists between the cam 212 and the clip 220 during normal operation. It is this contact area plus the spring force $F_S$ which holds the load blade contact 111 in contact with the line strap contact 113 during normal operation. As shown in FIG. 7, when the breaker is closed, the pivot spurs 320 of the cams 212 are close to, but not in contact with the surface 714 of the cross bar 114 (i.e. operating between locations represented by the phantom and solid lines in FIG. 7).

During a blow open condition, a repulsive magnetic force $F_m$ is exerted against the load blade 110. This force tends to rotate the blade 110 about the pivot pin 116 in a counter-clockwise direction. The force $F_m$ opposes the force $F_S$ of the spring 214. As the blade assembly is rotated, the pivot spur 320 engages the surface 714 of the crossbar assembly 114. This force causes the cam 212 to rotate counter clockwise about the point at which the spur 320 meets the surface 714. The oval pivot hole 630 in the cam 212 allows the cam 212 to slide to the left, in response to the force $F_m$, reducing the contact area between the surface 610 of the cam 212 and the bearing surface 514 of the load blade clip 220.

For a large repulsive magnetic force $F_m$, such as would occur during a blow off condition, the cam 212 pivots completely free of the load blade clip 220 allowing the front surface 516 of the load blade clip to slide along the surface 612 of the cam 212.

Figure 8:
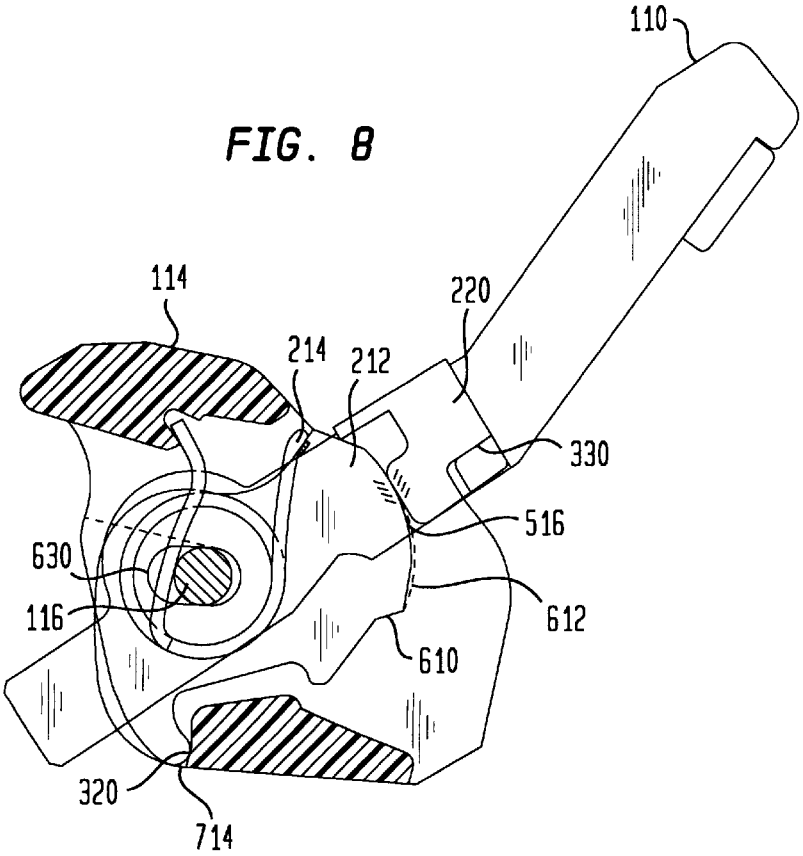
FIG. 8 is a cutaway view taken along the line 7—7 of FIG. 3A which illustrates the operation of the load blade and cam during a blow off condition.

FIG. 8 shows the crossbar 114, load blade 110, load blade clip 220 and cam 212 in the blown open position. In this position, the pivot spur 320 has engaged the surface 714 of the crossbar 114, causing the cam 612 to rotate in a counterclockwise direction. As shown, the cam moves to the left and the pivot pin is closer to the right hand side of the oval pivot hole 630 in the cam 212. As shown in FIG. 8, during the blow open condition, the front surface 516 of the load blade clip 220 slides along the surface 612 of the cam 212. The curvature of the surface 212 matches the pivot of the pivot pin 710 and thus the surfaces 516 and 612 may slide relatively easily. This allows the load blade to be pushed well away from the line contact in a blow off condition because, once the cam 612 has rotated so that the cam surface 610 disengages from the bearing surface 514, the force $F_C$ drops essentially to zero. This reduced force increases the opening speed of the load and line conductors. The increased speed is desirable to reduce the actual current flow through the breaker during a high-current fault condition.

As the load blade 110 and line strap 112 separate, the force $F_m$ decreases, and no longer counteracts the force $F_S$ of the spring 214. In this mode, the force $F_S$ presses the surfaces 516 and 612 together, increasing the frictional force. The frictional force between the surfaces 612 and 516 is proportional to the force $F_S$ exerted by the spring 214 and the area of contact between the cam 212 and the load blade clip 220. This frictional force is sufficient to prevent the load blade from rotating clockwise once contact between the load blade and the line contact has been broken, thus preventing the load blade from rebounding to the closed position while the circuit breaker is being opened by the instantaneous tripping mechanism.

Although the invention has been described in terms of an exemplary embodiment, it is contemplated that it may be practiced as outlined above within the scope of the following claims.

What is claimed:

1. A circuit breaker comprising:

a housing;

a crossbar pivotally connected to the housing to pivot on a first axis between open and closed positions;

a load contact arm having first and second sides, at least one of the first and second sides having a bearing surface, said load contact arm being pivotally connected to the crossbar to pivot about a second axis;

a cam, pivotally and slideably coupled to the crossbar and the load contact arm by a pivot pin to pivot and slide about the second axis, the cam including a cam surface;

biasing means coupled to the crossbar and to the cam for biasing the cam to a first position relative to the load blade, in the first position, the cam surface engages the bearing surface on the load contact arm to hold the load contact arm in a closed position when the crossbar is in the closed position wherein, when a repulsive magnetic force is applied to the load contact arm which applied force opposes the biasing force, the cam slides to a second position relative to the load contact arm, in the second position, the cam surface disengages from the bearing surface allowing the load contact arm to pivot about the second axis while the crossbar is in the closed position.

2. A circuit breaker according to claim 1, wherein the load contact arm includes a clip having first and second legs which are attached to the first and second sides of the load contact arm, at least one of the legs having a projection which forms the bearing surface.

3. A circuit breaker according to claim 1, wherein the load contact arm includes a pin, inserted in the load contact arm from the first side to the second side, the inserted pin projecting from at least one of the first and second sides of the load contact arm to form the bearing surface.

4. A circuit breaker according to claim 1, wherein the cam has upper and lower edges and the cam includes:

an oval pivot hole through which the pivot pin passes to couple the cam to the load contact arm and the crossbar, the oval pivot hole having first and second ends, wherein the pivot pin is closer to the first end than to the second end when the cam is in the first position relative to the load contact arm and the pivot pin is closer to the second end than to the first end when the cam is in the second position relative to the load contact arm; and a spur, extending from the lower edge of the cam, the spur engaging the crossbar when the force opposing the biasing force is applied to the load contact arm to form a further pivot point for the cam, wherein the cam pivots about the further pivot point between the first and second positions in response to the force opposing the biasing force.

5. A circuit breaker according to claim 1, further including:

a line contact arm which engages the load contact arm with a force defined by a first force vector when the crossbar is in the closed position and the cam is in the first position relative to the load contact arm;

wherein the cam surface engages the bearing surface with a force defined by a second force vector when the crossbar is in the closed position and the cam is in the first position relative to the load contact arm and the second force vector is approximately parallel to the first force vector, whereby the cam surface tends not to slide against the bearing surface when the crossbar pivots between the open and closed positions.

6. A circuit breaker according to claim 1, wherein:

the cam includes a front side edge having a further cam surface, the further cam surface having a radius of curvature defined relative to the second axis; and the load contact arm includes a further bearing surface which slides along the further cam surface of the cam when the load contact arm pivots about the second axis while the crossbar is in the closed position.

7. A circuit breaker according to claim 6 wherein the cam surface is defined as having an angle θ with respect to a tangent line extending from a lowest point of the further cam surface, and the angle θ is changed to change the level of the applied force that is needed to disengage the cam surface from the bearing surface.

8. A circuit breaker comprising:

a housing;

a crossbar pivotally connected to the housing to pivot between open and closed positions;

a load contact arm having first and second sides, at least one of the first and second sides having a bearing surface, said load contact arm being pivotally connected to the crossbar to pivot about an axis;

a cam, having upper and lower edges, the cam being mechanically coupled to the crossbar and slideably coupled to the load contact arm by a pivot pin to pivot about the axis and to slide between first and second positions, the cam including:

a cam surface;

a bias surface to which a bias force is applied to bias the cam in the first position, wherein, when the cam is in the first position, the cam surface engages the bearing surface on the load contact arm to hold the load contact arm, in a closed position when the crossbar is in the closed position a spur, extending from the lower edge of the cam, the spur engaging the crossbar when a force opposing the biasing force is applied to the load contact arm, to form a further pivot point for the cam, wherein the cam pivots about the further pivot point between the first and second positions in response to a force applied to the load contact arm;

biasing means coupled to the crossbar and to the cam, for applying the biasing force to the bias surface of the cam;

wherein, when the force is applied to the load contact arm, the cam slides to a second position relative to the load contact arm, in the second position, the cam surface disengages from the bearing surface allowing the load contact arm to pivot about the axis while the crossbar is in the closed position.

9. A circuit breaker according to claim 8, wherein the load contact arm includes a clip having first and second legs which are attached to the first and second sides of the load contact arm, at least one of the legs having a projection which forms the bearing surface.

10. A circuit breaker according to claim 8, wherein the load contact arm includes a pin, inserted in the load contact arm from the first side to the second side, the inserted pin projecting from at least one of the first and second sides of the load contact arm to form the bearing surface.

11. A circuit breaker according to claim 8, wherein:

the cam includes a front side edge having a further cam surface, the further cam surface having a radius of curvature defined relative to the axis; and the load contact arm includes a further bearing surface which slides along the further cam surface of the cam when the load contact arm pivots about the axis while the crossbar is in the closed position.

12. A circuit breaker according to claim 11 wherein the cam surface is defined as having an angle θ with respect to a tangent line extending from a lowest point of the further cam surface, and the angle θ is changed to change the level of the force, applied to the load contact arm, that is needed to disengage the cam surface from the bearing surface.

13. A circuit breaker comprising:

a housing;

a crossbar pivotally connected to the housing to pivot between open and closed positions;

a load contact arm having first and second sides, at least one of the first and second sides having first and second bearing surfaces, said load contact arm being pivotally connected to the crossbar to pivot about an axis;

a cam, having upper, lower, left and right edges, the cam being mechanically coupled to the crossbar and slideably coupled to the load contact arm by a pivot pin to pivot about the axis and to slide between first and second positions, the cam including:

a first cam surface on the right edge of the cam;

a bias surface on the upper edge of the cam to which a bias force is applied to bias the cam in the first position, wherein, when the cam is in the first position, the cam surface engages the bearing surface on the load contact arm to hold the load contact arm in a closed position when the crossbar is in the closed position a spur, extending from the lower edge of the cam, the spur engaging the crossbar when a force opposing the biasing force is applied to the load contact arm to form a further pivot point for the cam, wherein the cam pivots about the further pivot point between the first and second positions in response to a force applied to the load contact arm;

a second cam surface, on the right edge of the cam, extending from first the cam surface, the second cam surface having a radius of curvature defined relative to the axis; and biasing means coupled to the crossbar and to the cam, for applying the biasing force to the bias surface of the cam;

wherein, when the force is applied to the load contact arm, the cam slides to a second position relative to the load contact arm, in the second position, the first cam surface disengages from the first bearing surface and the second cam surface slides along the second bearing surface, allowing the load contact arm to pivot about the axis while the crossbar is in the closed position.

14. A circuit breaker according to claim 13, wherein the load contact arm includes a clip having first and second legs which are attached to the first and second sides of the load contact arm, at least one of the legs having a projection which forms the first bearing surface.

15. A circuit breaker according to claim 13, wherein the load contact arm includes a pin, inserted in the load contact arm from the first side to the second side, the inserted pin projecting from at least one of the first and second sides of the load contact arm to form the first bearing surface.

* * * * *